United States Patent [19]

Henson

[11] Patent Number: 4,521,930

[45] Date of Patent: Jun. 11, 1985

[54] PISTOL MOUNTING BRACKET

[76] Inventor: Jack C. Henson, 881 Elwood, Abilene, Tex. 79065

[21] Appl. No.: 439,827

[22] Filed: Nov. 8, 1982

[51] Int. Cl.[3] ..... A47B 96/06

[52] U.S. Cl. ..... 5/508; 5/503

[58] Field of Search ..... 5/503, 504, 508, 507; 248/205 R, 300, 216.1, 314; 224/911; 29/428

[56] References Cited

U.S. PATENT DOCUMENTS

| | | | |
|---|---|---|---|
| 1,579,552 | 4/1926 | Ludlow . | |
| 1,686,002 | 10/1928 | Herzon | 5/503 |
| 1,964,035 | 6/1934 | Cross | 224/911 |
| 1,969,258 | 8/1934 | Cross | 224/911 |
| 2,216,876 | 10/1940 | Crum | 24/81 |
| 2,557,674 | 6/1951 | McRae | 5/503 |
| 3,482,810 | 12/1969 | Bailey | 5/503 |
| 3,796,358 | 3/1974 | Grubb | 224/2 C |
| 4,141,524 | 2/1979 | Corvese, Jr. | 5/503 |
| 4,461,442 | 7/1984 | Keenan | 5/508 |

*Primary Examiner*—Gary L. Smith
*Assistant Examiner*—Michael F. Trettel
*Attorney, Agent, or Firm*—James E. Bradley

[57] ABSTRACT

A pistol mounting bracket is shown for mounting a pistol holster of the type having a pistol receiving pouch and a belt loop attached to the pouch for securing the holster to the body of a wearer onto a bed. The mounting bracket has a support arm which is adapted to be fitted under the bed mattress and a holding arm connected to the support arm and depending therefrom in a plane generally perpendicular to the plane of the support arm. The holding arm has a connecting end fixed to the support arm and an opposite flange end adapted to be slidingly received within the belt loop of the pistol holster.

1 Claim, 3 Drawing Figures

PISTOL MOUNTING BRACKET

BACKGROUND OF THE INVENTION

The present invention relates generally to a pistol holding device of the type used for mounting a pistol on a furniture structure and specifically to a pistol holding device for mounting a pistol holster onto a bed.

Various types of holsters, carrying clips, and the like are known in the prior art for storing and carrying pistols. However, in general the prior art devices do not provide a gun holding device particularly adapted to mounting on furniture such as on the side of a bed. Certain of the prior devices which were intended for mounting a pistol onto furniture required a specially constructed pistol holster or required modification to the furniture structure such as drilling holes, or the like. Such holding devices were not easily removed from the furniture structure and, in some cases, detracted from the appearance of the furniture.

There exists a need, therefore, for a pistol holding device, the purpose of which is to enable a revolver or pistol to be held ready for instant use, to protect a person.

There exists a need for such a device which is of relatively simple construction and which can be very readily attached and detached in an inconspicuous place by the side of a bed which would be easily accessible by an occupant of the bed at night.

SUMMARY OF THE INVENTION

The pistol mounting bracket of the invention used to mount a pistol holster onto a bed has a support arm for fitting under a mattress. A holding arm connected to the support arm and depending therefrom in a plane generally perpendicular to the plane of the support arm has means for supporting a pistol holster.

Preferably, the pistol mounting bracket is used for mounting a holster of the type having a pistol receiving pouch and a belt loop attached to the pouch for securing the holster to the body of the wearer. The support arm is generally planar and has a longitudinal extent adapted to be fitted under a bed mattress. The length of the support arm is selected so that the weight of the bed mattress is sufficient to retain the support arm on the bed. A holding arm, generally rectangular in shape, has a fixed end connected to the support arm and depending therefrom in a plane generally perpendicular to the plane of the support arm and has an opposite flange end with means for supporting a pistol holster. The pistol holster is supported from the flange end by passing the flange end through the holster belt loop.

In the method of the invention of mounting a pistol holster onto a bed, a mounting bracket is provided having a support arm for fitting under the bed mattress and a holding arm connected to the support arm and depending therefrom in a plane generally perpendicular to the plane of the support arm. The support arm is placed under the bed mattress so that the weight of the mattress retains the support arm on the bed. The holster belt loop is then slid over the holding arm end opposite the the holding arm end opposite the connection to the support arm, the holster must be canted to allow the belt loop to slide over the protrusion during installation and removal of the holster from the holding arm to ensure that the holster will be retained on the holding arm.

Additional objects, features, and advantages will be apparent in the written description which follows.

DETAILED DESCRIPTION OF THE INVENTION

Figure 1:
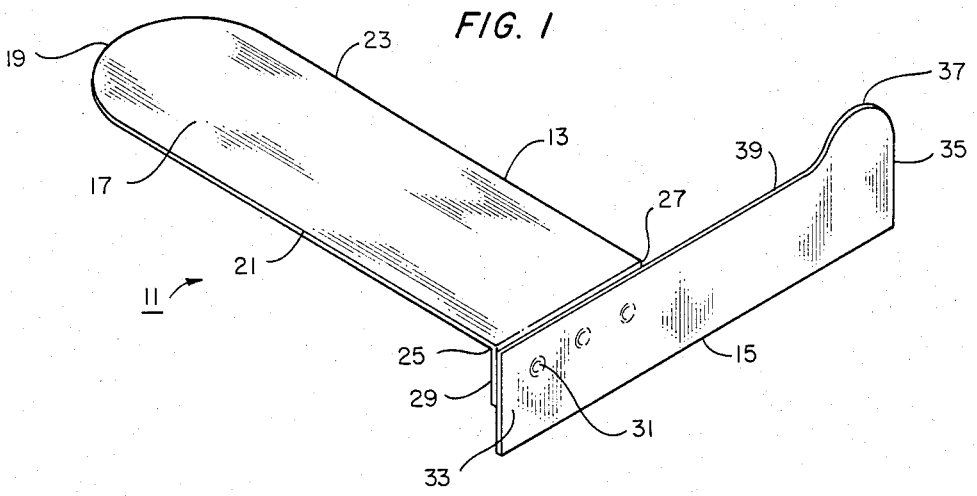
FIG. 1 is a perspective view of the mounting bracket of the invention for mounting a pistol holster onto a bed.

Turning to FIG. 1 there is shown a pistol mounting bracket designated generally as 11. The pistol mounting bracket has a support arm 13 for fitting under a bed mattress and a holding arm 15 connected to the support arm and depending therefrom in a plane generally perpendicular to the plane of the support arm. The support arm 13 is a generally planar member having a longitudinal extent 17 adapted to be fitted under a mattress. In the preferred embodiment, the support arm is a generally rectangular shape having a curved end 19 with rounded edges to facilitate insertion between the mattress and box springs of a bed. The opposing edges 21, 23 of the support arm 13 run from the curved end 19 toward opposing corners 25, 27. A downwardly facing leg 29 of the support arm 13 is arranged at a right angle to the support arm 13 for ease of attachment to the holding arm 15 as by rivets 31. Although the shape and dimensions of the support arm 13 are not critical, the upper exposed surface area of the longitudinal extent 17 should be appreciably greater than the thickness of the support arm 13 to allow the support arm 13 to be easily inserted under a mattress without tearing the fabric and, at the same time, providing sufficient support surface so that the weight of the mattress is sufficient to retain the support arm 13 on a bed.

The holding arm 15 is also generally rectangular in shape and has a fixed end 33 connected to the support arm downwardly facing leg 29. The holding arm 15 depends from the support arm 13 in a plane generally perpendicular to the plane of the support arm 13 and has a flange end 35 opposite the fixed end 35 which provides a means for supporting a pistol holster. The flange end 35 can be provided with a protruding portion 37 on the top edge 39 thereof for retaining a pistol holster in place on the holding arm 15 as will be more fully described.

Figure 2:
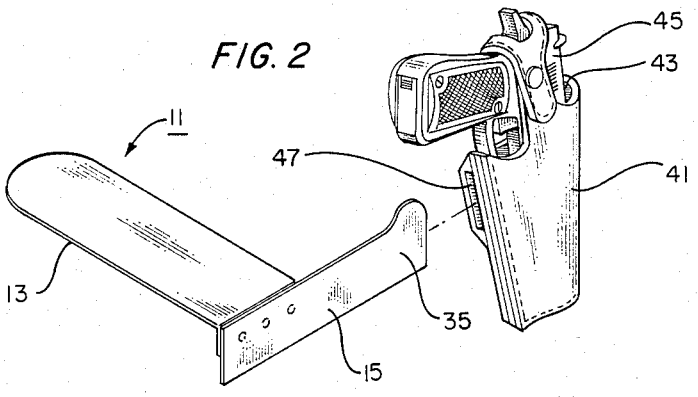
FIG. 2 is a perspective view of the mounting bracket of FIG. 1 showing a pistol holster in place to be supported on the bracket.

As shown in FIG. 2, the pistol mounting bracket 11 is intended to be used with a pistol holster 41 of the type having a pistol receiving pouch 43 for receiving a pistol 45 and a belt loop 47 attached to the pouch 43 for securing the holster 41 to the body of a wearer (not shown). The flange end 35 of the holding arm 15, as shown in FIG. 2, is adapted to be slidingly received within the belt loop 47 of the holster pouch 43 to support the pouch 43.

Figure 3:
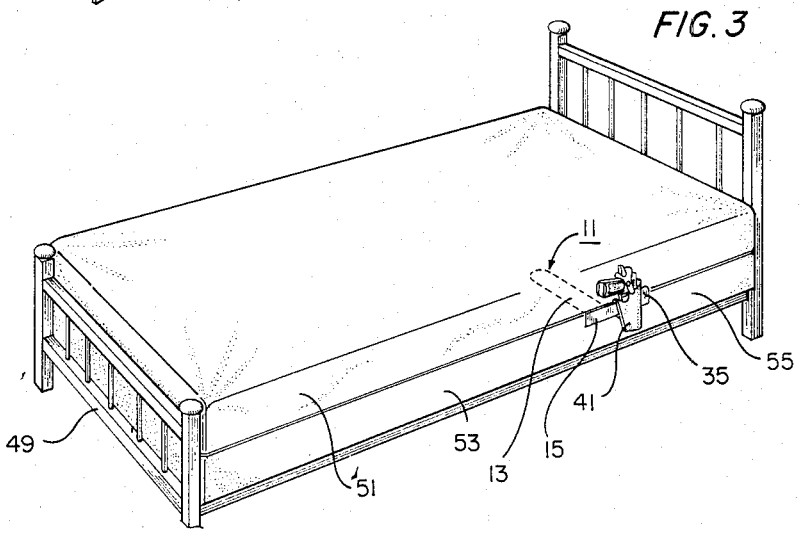
FIG. 3 is a perspective view of the pistol mounting bracket supporting a pistol holster on the side of a bed.

The method of mounting a pistol holster onto a bed will now be described with reference to FIG. 3. The mounting bracket is provided with a support arm 13 for fitting between the mattress 51 of the bed 49 and the box springs 53 of the bed. The holding arm 15 of the bracket is connected to the support arm 13 and depends therefrom in a plane generally perpendicular to plane of the support arm 13. The support arm, as shown in FIG. 3, is placed under the mattress 51 so that the weight of the mattress 51 retains the support arm 13 on the bed 49 with the holding arm 15 being flush against and aligned with the sidewall 55 of the box springs 53. The holster belt loop 47 can be slid over the holding arm end 35 opposite the connection to the support arm to thereby support the holster on the holding arm 15. By providing a protruding portion 37 in the holding arm end 35 opposite the connection to the support arm, the holster must be canted slightly to allow the belt loop 47 to slide over the protrusion 37 during installation and removal of the holster from the holding arm 15. The flange end protruding portion 37 provides a greater relative width to the holding arm 15 and at the flange end 35 than at the fixed end 33 to thereby resist sliding movement of the holster loop 47 along an axis parallel to the longitudinal axis of the holding arm 15.

An invention has been provided with significant advantages. The pistol mounting bracket of the invention is simple in construction and inexpensive to manufacture. The mounting bracket is easily supported from a bed without altering the bed furniture such as by inserting screws in the bed frame. The pistol mounting bracket can be temporarily removed from the bed by removing the support arm from under the mattress while leaving the belt loop of the pistol holster engaged on the mounting bracket holding arm. In this way, the pistol mounting bracket and pistol could be removed from the bed during the daytime and quickly reattached at night. The alignment of the pistol holster with the sidewall of the bed mattress conceals the pistol outline allowing the pistol and mounting bracket to be "made up" under the bed coverings if desired. The pistol mounting bracket provides convenient access to a pistol for protection of the person at night. Since the pistol is retained in the holster pouch, the gun metal is not exposed to surfaces which might scratch the metal or damage the finish of the gun.

While the invention has been shown in only one of its forms, it is not thus limited but is susceptible to various changes and modifications without departing from the spirit thereof.

I claim:

1. A pistol mounting bracket for mounting a pistol holster onto a bed, the pistol holster being of the type having a pistol receiving pouch and a belt loop attached to the pouch for securing the holster to the body of the wearer, comprising:

a generally planar support arm having a longitudinal extent adapted to be fitted under a bed mattress, the length of said support arm being selected so that the weight of said bed mattress is sufficient to retain said support arm on said bed; and a holding arm, generally rectangular in shape, having a fixed end connected to said support arm and depending therefrom in a plane generally perpendicular to the plane of the support arm and having an opposite flange end adapted to be slidingly received within the belt loop of said holster pouch with means for supporting a pistol holster, said means including a protruding portion at an outer extent of said flange end which provides greater relative width to said holding arm at said flange end than at said fixed end to thereby resist sliding movement of said holster loop along an axis parallel to the longitudinal axis of said holding arm.

* * * * *